US011959698B2

(12) United States Patent
Nelson et al.

(10) Patent No.: US 11,959,698 B2
(45) Date of Patent: Apr. 16, 2024

(54) LIQUID NITROGEN DISPENSING HEAD

(71) Applicant: NITROcrete, LLC, Fort Collins, CO (US)

(72) Inventors: Drew R. Nelson, Fort Collins, CO (US); Eric L. Van Dixhorn, Fort Collins, CO (US); John C. Gebhart, Fort Collins, CO (US); Michael R. Schauer, Fort Collins, CO (US)

(73) Assignee: NITROcrete, LLC, Fort Collins, CO (US)

( * ) Notice: Subject to any disclaimer, the term of this patent is extended or adjusted under 35 U.S.C. 154(b) by 217 days.

(21) Appl. No.: 17/323,940

(22) Filed: May 18, 2021

(65) Prior Publication Data

US 2021/0364216 A1 Nov. 25, 2021

Related U.S. Application Data

(60) Provisional application No. 63/027,319, filed on May 19, 2020.

(51) Int. Cl.
*F25D 3/11* (2006.01)
*F25D 25/04* (2006.01)

(52) U.S. Cl.
CPC ..... *F25D 3/11* (2013.01); *F25D 25/04* (2013.01)

(58) Field of Classification Search
CPC ..... F25D 3/11; F25D 25/04; B05B 13/0221; B05B 1/14
USPC ..... 62/63
See application file for complete search history.

(56) References Cited

U.S. PATENT DOCUMENTS

2018/0058744 A1* 3/2018 Newman ..... F25B 19/005
2018/0252444 A1 9/2018 Nelson et al.
2020/0069590 A1 3/2020 Amoro et al.

FOREIGN PATENT DOCUMENTS

WO WO-2018164779 A1 * 9/2018 ..... B01F 13/0037

OTHER PUBLICATIONS

International Searching Authority, International Search Report and Written Opinion, mailed in relationship to International Application No. PCT/US2021/033238, dated Sep. 2, 2021 (14 pages).

* cited by examiner

*Primary Examiner* — Steve S Tanenbaum
(74) *Attorney, Agent, or Firm* — Taft Stettinius & Hollister LLP

(57) ABSTRACT

An apparatus, system, device, and the like, for a liquid nitrogen dispensing head that may be used in a system for cooling aggregate, such as may be found in a batch plant involved in producing concrete. The dispensing head is positioned over a conveyor belt that conveys aggregate to a mixing apparatus to produce concrete. The head dispenses liquid nitrogen onto the aggregate to cool the aggregate and may include interior chambers separated by one or more baffles. The chambers may reduce the pressure of the liquid nitrogen onto the aggregate in relation to the flow pressure of the liquid nitrogen entering the dispensing head. In another example, an assembly may include sidewalls that extend to the aggregate on either side of the head to form a cooling tunnel through which the aggregate is conveyed and is exposed to the liquid nitrogen being dispensed from the head.

13 Claims, 6 Drawing Sheets

LIQUID NITROGEN DISPENSING HEAD

CROSS-REFERENCE TO RELATED APPLICATION

This application is related to and claims priority under 35 U.S.C. § 119(e) from U.S. Patent Application No. 63/027,319, filed May 19, 2020 and titled "LIQUID NITROGEN DISPENSING HEAD," the entire contents of which is incorporated herein by reference for all purposes.

TECHNICAL FIELD

Aspects of the present disclosure involve cooling aggregate for concrete manufacturing, and more particularly involves a head for dispensing liquid nitrogen on aggregate on a conveyor running under the head, such as in a concrete batch processing plant.

BACKGROUND AND INTRODUCTION

Concrete is made from mixing cement with water. Concrete processing also involves mixing aggregate, typically sand and gravel or rock, with the cement and water. Mixing cement and water produces heat—it is an exothermic reaction. Proper curing of the concrete is negatively affected when temperatures exceed various thresholds, and this problem is exacerbated by the exothermic reaction. Thus, techniques have been developed to cool the concrete, or some component of the concrete, so that the concrete is and remains cool enough to cure properly.

In a simple example, in place of some of the water used to produce concrete, ice is added into the mixture. In one example, ice is loaded into a mixing truck where the components are mixed to produce concrete. This technique is burdened by a variety of problems including the amount of ice that can be added (which is limited by the amount of water in the mix) and the imprecision of the mixing operation when ice replaces water given that the correct proportions of water and concrete are needed to produce quality cement. Moreover, regardless of the availability of ice, only limited quantities may be added in any given application limiting the cooling effect to the amount of ice that may be added to the mixture.

In more sophisticated approaches, liquid nitrogen has been used to cool the aggregate or the mixture in the truck. For nitrogen to be in a liquid state, its temperature must be at or below −320 F at atmospheric pressure, which temperatures can be damaging to many concrete manufacturing components. Liquid nitrogen "boils" almost instantly when exposed to warmer temperatures and the transition to gas at that temperature is accompanied by a large volume increase—in some instances 700 times or greater depending on the pressure. The transition and pressure make distribution onto aggregate very challenging, particularly in a hot outside environment. The pressure accompanying volume increases, for example, tends to blast aggregate off the belt. The gas transition makes penetration into the aggregate, piled on the belt, difficult. Moreover, the extreme cold temperatures can damage the belt and the conveyor components.

It is with these observations in mind, among others, that aspects of the present disclosure were conceived and developed.

SUMMARY

One aspect of the present disclosure relates to an apparatus comprising a head coupleable with a source of liquid nitrogen. The head may include a first area that receives liquid nitrogen, at least one distribution chamber in fluid communication with the first area, and at least one obstruction in a fluid path between the first area and the distribution area, the distribution area including a plurality of ports directing liquid nitrogen onto aggregate being carried on a belt beneath the head.

Another aspect of the present disclosure relates to a device for dispensing a liquid coolant. The device may include an interior reservoir in fluid communication with an intake port, the interior reservoir comprising a plurality of baffle walls extending into the interior reservoir and a plurality of distribution chambers separated from the interior reservoir by the plurality of baffle walls. The device may further include a plurality of output ports disposed along a bottom surface of the plurality of distribution chambers, the plurality of output ports directing the liquid coolant onto an aggregate being carried on a belt beneath the device.

Another aspect of the present disclosure involves liquid nitrogen dispensing head coupleable with a source of liquid nitrogen. The head includes a first area that receives liquid nitrogen and at least one distribution chamber in fluid communication with the first area. The head further includes at least one obstruction, which may be a baffle, in a fluid path between the first area and the distribution area. The distribution area includes a plurality of apertures directing liquid nitrogen onto aggregate being carried on a belt beneath the head. The distribution chamber may comprise a first distribution chamber on a first side of the first area and a second distribution chamber on a second side of the first area, the first area defining a first volume less than a volume of the first distribution chamber or a volume of the second distribution chamber. The volume of the first area may be defined generally as the area into which the liquid nitrogen flows before distribution into the adjacent chamber or chambers. The at least one obstruction may comprise a first baffle between the first area and the first distribution chamber and a second baffle between the first area and the second distribution chamber. A first gap is defined between the first baffle and the first distribution area that provides the fluid path between the first area and the first distribution chamber. A second gap is defined between the second baffle and the second distribution area that provides the fluid path between the first area and the second distribution chamber. The plurality of apertures may comprise a first plurality of apertures of a first dimension disposed along a bottom surface of the head and a second plurality of apertures of a second dimension less than the first dimension disposed on the bottom surface of the head, the first plurality of apertures directing the liquid nitrogen at a relatively greater volume onto the aggregate as compared to the second plurality of apertures. The head may further comprise a first plate extending downward from a first edge of the head toward the belt and a second plate extending downward from a second edge of the head toward the belt, where the first plate and the second plate are positioned to retain aggregate from being blown off the belt and between the first plate and the second plate as the aggregate passes beneath the head and/or form a cooling tunnel into which liquid nitrogen passes through the plurality of apertures.

Another aspect of the present disclosure involves a device for dispensing a liquid coolant that comprises an interior reservoir in fluid communication with an intake port where the interior reservoir is bounded, at least in part, by a plurality of baffle walls. The device further includes a plurality of distribution chambers separated from the interior reservoir by the plurality of baffle walls. The device further includes a plurality of output apertures disposed along a bottom surface of the plurality of distribution chambers where the plurality of output ports directing the liquid coolant onto an aggregate being carried on a belt beneath the device. In one example, the liquid coolant enters the interior reservoir through the intake port at a first flow rate toward a lower solid surface of the reservoir between at least two of the plurality of baffle walls. The liquid coolant is deflected by the lower solid surface and otherwise flows between respective gaps between the two baffle walls and the respective distribution chambers. The device may further include a first sidewall extending downward from a first side of the plurality of output ports and a second sidewall extending downward from a second side of the plurality of output ports. The first sidewall and the second sidewall define a cooling tunnel into which the liquid nitrogen flows through the plurality of ports and through which aggregate conveyed on the belt passes.

Another aspect of the disclosure involves a liquid nitrogen dispensing head to distribute liquid nitrogen to aggregate being conveyed on a belt, the head comprising a reservoir defined by a first solid wall and a second wall including an inlet port that received liquid nitrogen, the inlet port oriented toward the first solid wall. The head further includes a first baffle extending from the first solid wall where the first baffle separates the reservoir and a first distribution chamber extending in a first direction from the reservoir. A first liquid nitrogen flow path is defined between the first baffle and the first distribution chamber. The first distribution chamber comprises a plurality of ports oriented to distribute liquid nitrogen to aggregate being conveyed on a rubber belt below the first distribution chamber. The head further includes a second baffle extending from the second solid wall where the second baffle separates the reservoir and a second distribution chamber extending in a second direction from the reservoir. A second liquid nitrogen flow path is defined between the second baffle and the second distribution chamber. The second distribution chamber comprises a plurality of ports oriented to distribute liquid nitrogen to aggregate being conveyed on the rubber belt below the second distribution chamber. In one example, the liquid nitrogen dispensing head is vertically adjustable relative to belt, and the first plurality of ports include at least one first set of ports of a first dimension and oriented generally above a longitudinal centerline of the belt and at least one second set of ports of a second dimension outward from the at least one first set of ports, where the second dimension is smaller than the first dimension. In this arrangement, relatively more liquid nitrogen is distributed onto the aggregate toward the longitudinal centerline of the belt and relatively less liquid nitrogen on the outer edges of the belt. Aggregate tends to be heaped and deeper along the centerline relative to the outer sides as the belt bows under the weight of aggregate and is poured onto the belt along the centerline thus more cooling is headed in the deeper aggregate, and distributing less cooling toward the edges further mitigates liquid nitrogen contact on the outer edges of the belt which are more likely to be exposed and not protected by aggregate on the belt.

These and other aspects of the present disclosure are discussed in more detail in the detailed description section that follows.

BRIEF DESCRIPTION OF THE FIGURES

The foregoing and other objects, features, and advantages of the present disclosure set forth herein should be apparent from the following description of particular embodiments of those inventive concepts, as illustrated in the accompanying drawings. The drawings depict only typical embodiments of the present disclosure and, therefore, are not to be considered limiting in scope.

DETAILED DESCRIPTION

Aspects of the present disclosure involve a liquid nitrogen dispensing head that may be used in a system for cooling aggregate, such as may be found in a batch plant involved in producing concrete. In one example, the dispensing head is positioned over a conveyor belt that conveys aggregate to a mixing truck or otherwise where cement and water are added to the aggregate to produce concrete. The head dispenses liquid nitrogen onto the aggregate to cool the aggregate. In one example, the head dispenses liquid nitrogen along a longitudinal extent of aggregate on the belt and being conveyed under the head. In one example, the longitudinal extent is 2-5 feet, and in another example 4-5 feet, to optimize penetration of nitrogen into the aggregate. In various implementations, the head dispenses liquid nitrogen so as to optimize penetration of nitrogen into the aggregate to more uniformly cool the aggregate while mitigating the spreading of the aggregate outside of the conveyor belt. The dispensing head may include one or more interior chambers separated by one or more baffles. The chambers may reduce the pressure of the liquid nitrogen onto the aggregate in relation to the flow pressure of the liquid nitrogen entering the dispensing head. The dispensing head may also include a wear plate mounted on one end of the head to prevent wear on the head from aggregate passing below the head on the conveyor belt.

In another example, an assembly, which may include the dispensing head, includes sidewalls (e.g. plates) that extend to the aggregate on either side of the head to collectively form a cooling tunnel through which the aggregate is conveyed and is exposed to the liquid nitrogen being dispensed from the head. The ambient environment of the tunnel is cooled by the liquid nitrogen, enhancing the cooling effect of the system. The tunnel may also help delay the liquid to gas transition of the liquid nitrogen being dispensed from the head. Moreover, the sidewalls retain aggregate within the tunnel and avoid blasting the aggregate off the belt as some liquid nitrogen transitions to the gas phase. The sidewalls also reduce or eliminate contact between the liquid nitrogen and the belt and conveyor components, extending the life of those components and reducing any damage from the liquid nitrogen.

Figure 1:
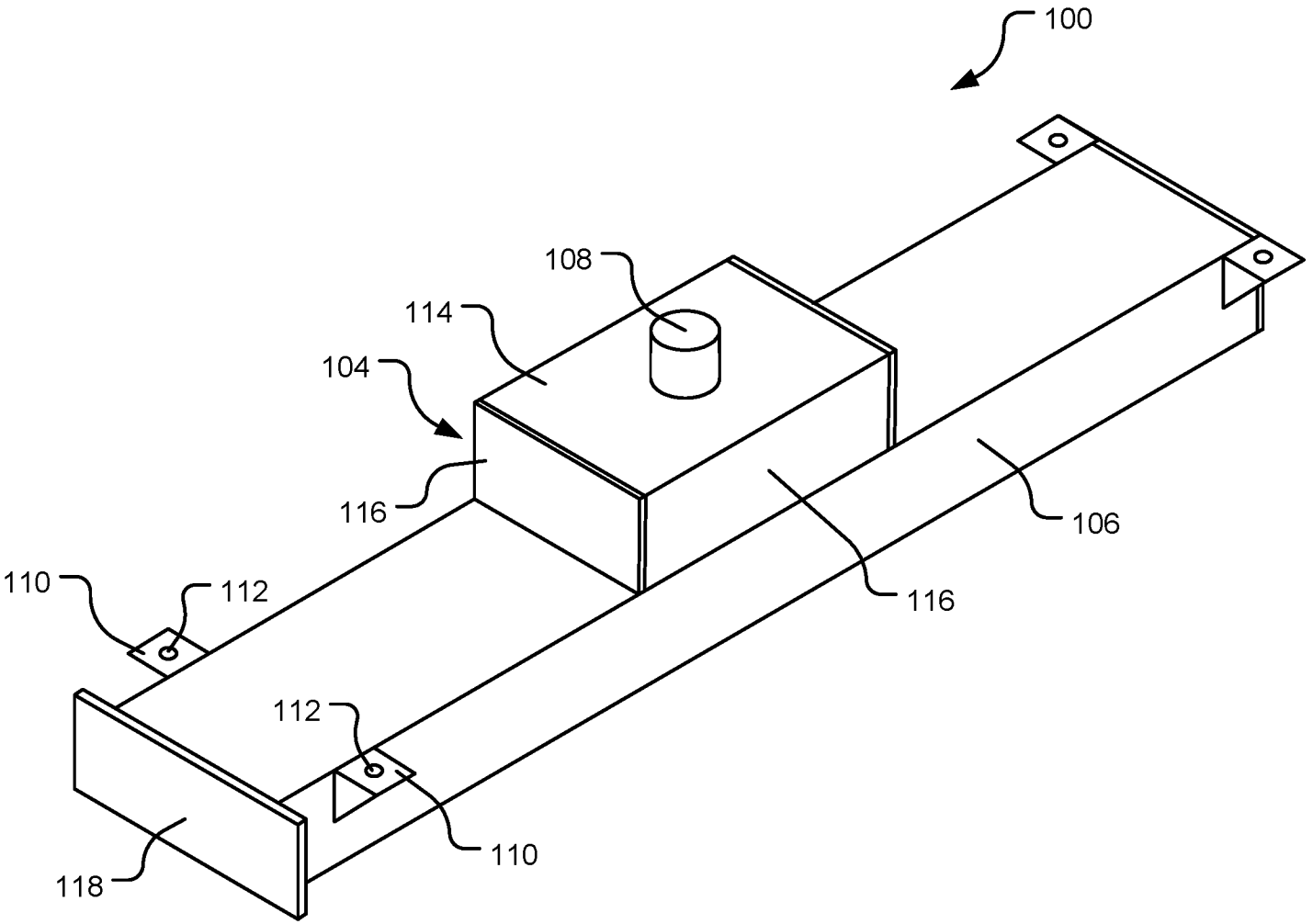
FIG. 1 is an isometric representative view of a head assembly for dispensing a liquid according to one embodiment.
Figure 2:
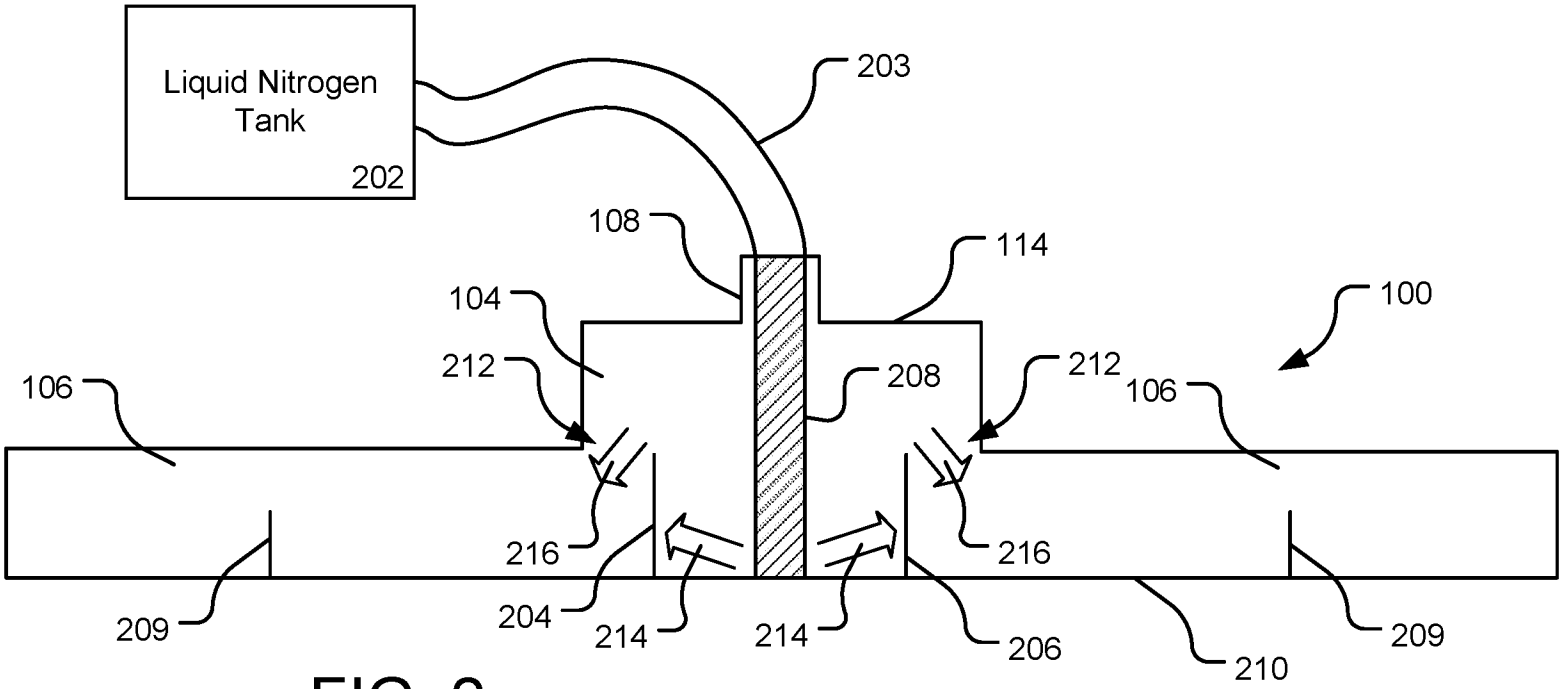
FIG. 2 is a side representative section view of a head assembly for dispensing a liquid as shown in FIG. 1.
Figure 3:
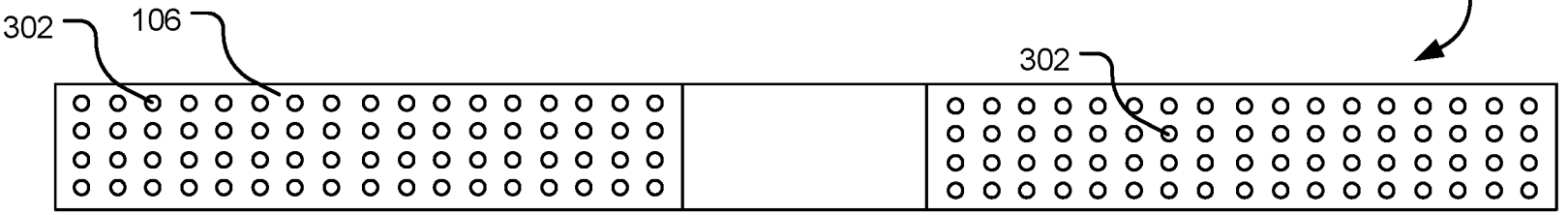
FIG. 3 is a bottom view of the head assembly for dispensing a liquid as shown in FIG. 1.

In more detail and referring to FIGS. 1-3, one example of a dispensing head 100 may comprise a reservoir area 104 that receives the liquid nitrogen 208 from a tank 202 through an intake port 108. The head 100 may include distribution chambers 106 to either side of the reservoir 104. The intake port 108 provides an entry into the reservoir 104 into which liquid nitrogen 208 flows, although the head 100 may also be used to dispense other types of liquid introduced into the reservoir 104 through the intake port 108. The intake port 108, in one example, is positioned in an upper wall 114 of the head 100 such that liquid nitrogen flows downward into the reservoir area 104. The intake port 108, however, can be positioned on sidewalls, such as sidewalls 116, and the head 100 may include other ways of receiving liquid nitrogen. The intake port 108 may include a suitable coupling to interconnect with a pipe coupled with a tank 202 or other source of liquid nitrogen. In one example, a flexible section of hose 203 is included in the path between the tank 202 of liquid nitrogen and the head 100 so that the head can be raised and lowered while the tank remains static.

The head 100, in one example illustrated in FIG. 1 and others, includes a generally rectangular main enclosure. More particularly, the distribution chambers 106 may define a lower rectangular main enclosure. The upper wall 114 and sidewalls 116 of the reservoir may define an upper rectangular enclosure that extends above the distribution chambers 106. As shown in FIG. 2, a lower interior of the reservoir section 104 is defined by two baffles, a first baffle 204 and a second baffle 206, extending upward from a bottom surface 210 of the head 100. The intake port 108 is positioned in a top surface of the reservoir portion 104 of the enclosure that extends above the top surface of the adjacent chambers 106. In one implementation, the intake port 108 is positioned above and between the baffles 204, 206 such that at least a portion of the liquid nitrogen 208 entering the reservoir 104 through the intake port 108 is flows or otherwise sprays depending on pressure on the bottom surface 210 between the baffles 204, 206. The figures illustrates a fairly straight volume of liquid from the port to the bottom surface but it should be recognized that the liquid nitrogen into the reservoir area may spread out, and some liquid nitrogen may pass directly through the gaps into the respective chambers. In some instances, one or more valves may be included through the liquid conduit between the liquid nitrogen tank 202 and the intake port 108. The valves may be adjustable to control the rate of flow of liquid nitrogen into the dispensing head 100, including stopping the flow of liquid into the reservoir 104. The chambers 106 and reservoir 104 may be enclosed such that the liquid nitrogen 208 flowing into the head 100 is retained within the head for dispersal through one or more output ports 302 through the bottom surface 210 of the distribution chambers 106, described in more detail below.

The reservoir 104 may include spaces 212, e.g., gaps, between the baffles 204, 206 and the top surface 114 of the reservoir. Liquid nitrogen 208 flowing into the reservoir 104 may follow a fluid path from the intake port 108 to the bottom surface 210 of the reservoir 104. The liquid nitrogen 208 is then deflected, by the bottom surface 210, in all directions within the reservoir 104, as indicated by flow arrows 214. The deflected liquid nitrogen 208 is directed by the sidewalls and some obstruction, e.g., the baffles 204, 206, upward to at least partially fill the area within the reservoir 104. The liquid nitrogen 208 may follow an indirect path into the adjacent distribution chambers 106 through the spaces 212 between the baffles 204, 206 and the top surface 114 (flow arrows 216). Thus, the first area (the reservoir area 104) is in indirect fluid communication with the adjacent chambers 106. The deflected liquid nitrogen, as well as some liquid nitrogen 208 directly from the intake port 108, may then flow through the gaps 212 and follow the fluid path into the adjacent chambers 106 where the liquid nitrogen then flows from one or more output ports 302 in the respective chambers 106 onto an aggregate being conveyed below the head 100. It should be recognized that some liquid nitrogen 208 will "boil" inside the head 100 or upon exiting the head so reference herein to liquid nitrogen recognizes that phase transitions will occur at various times and locations as the liquid nitrogen is conveyed from the source, e.g., a tank 202, to and through the head, to the aggregate.

In one possible example, the gaps 212 between the baffles 204, 206 and the top surface 114 of the reservoir 104 are about 2 inches and the baffles are solid panels extending the width of the head enclosure and with a height matching the height of the adjacent chambers 106. Should the upper rectangular enclosure of the reservoir 104, including the intake port 108, be removed, the baffles 204, 206 may be less than the height of the distribution chambers 106 to provide the gaps 212 there between. Other flow paths may be provided between the reservoir area 104 and the distribution chambers 106. For example, a gap, continuous or broken, may be provided between a baffle 204, 206 and one or both enclosure sidewalls. In another example, perforations may be provided in the baffles 204, 206 to provide fluid transfer from the reservoir 104 and the distribution chambers 106. In yet another example, the height of the baffles 204, 206 and/or the gap spacing 212 may be adjustable to control the flow from the reservoir 104 and the distribution chambers 106.

Referring again to FIG. 1, the dispensing head 100 may include one or more mounting brackets 110 disposed on an outer surface of the head. In one instance, the mounting brackets 110 may be an inverted-L shaped bracket. One or more of the mounting brackets 110 may also include a mounting hole 112 through which a connector, such as a screw, bolt, pin, or any other type of connector, may pass through the bracket 110. In one specific example, the head is hung from a support structure above the head by way of threaded rods passing though the respective mounting holes at each corner of the head. The head is held in place by corresponding nuts secured to each rod. Moreover, the height of the head relative to the belt may be adjusted by way of turning the nuts to raise or lower the head being secured to the threaded rods. In other instances, however, any type of mounting bracket may be included on the head 100 for mounting the head to a supporting structure.

The head 100 may also include a rectangular wear plate 118 mounted to a leading edge or side of the head. The circumference of the wear plate 118 may be larger than the circumference of a cross-section of the distribution chambers 106. The wear plate 118 may prevent damage to the outer surface of the head 100 by aggregate being conveyed below a mounted head, and where some of the mounded aggregate on the conveyor strikes the head. In particular, the wear plate 118 may absorb the impact of conveyed aggregate that strikes the dispensing head 100 and also cause the aggregate to be displaced around or below the head. The plate is shown as being flat against the head but it may also be sloped to deflect aggregate downward. In some instances, the wear plate 118 may take other forms to displace aggregate conveyed below the head 100, such as a wedge shape to both guide the aggregate down and around the body of the head 100.

Referring now to FIG. 3, it can be seen that the bottom of each of the distribution chambers 106 includes output ports 302 in the bottom surface. In one implementation, the distribution chambers 106 includes rows and columns of output ports 302 distributed across the length of each chamber. The number, distribution, and size of the output ports 302 may be adjusted for any given application as well as based on the dimensions of the head 100 itself. Similarly, the positioning of the head 100 may also be adjusted based on various factors, including the spacing in a batch plant available for positioning the head over a belt conveying aggregate. The number of rows, here four are shown, the corresponding width of the head may be tailored to the belt size of any given batch plant. Generally speaking, the width of the head is slightly narrower than the width of the belt. Moreover, the lateral width of the belt under aggregate load may also be considered, with the lateral width under aggregate load being less than the width unloaded.

Although shown with two baffles 204, 206, the head 100 may include additional baffles positioned along the distribution chambers 106 to assist in evening distribution from the output ports 302. For example, baffles 209 of consistent or varying height may extend upward from the bottom surface 210 of the respective distribution chambers 106 and positioned between columns or rows of the output ports 302. The additional baffles 209 may control or otherwise modify the flow and distribution of the liquid nitrogen through the distribution chambers 106 and to the output ports 302 within a given chamber.

Figure 4:
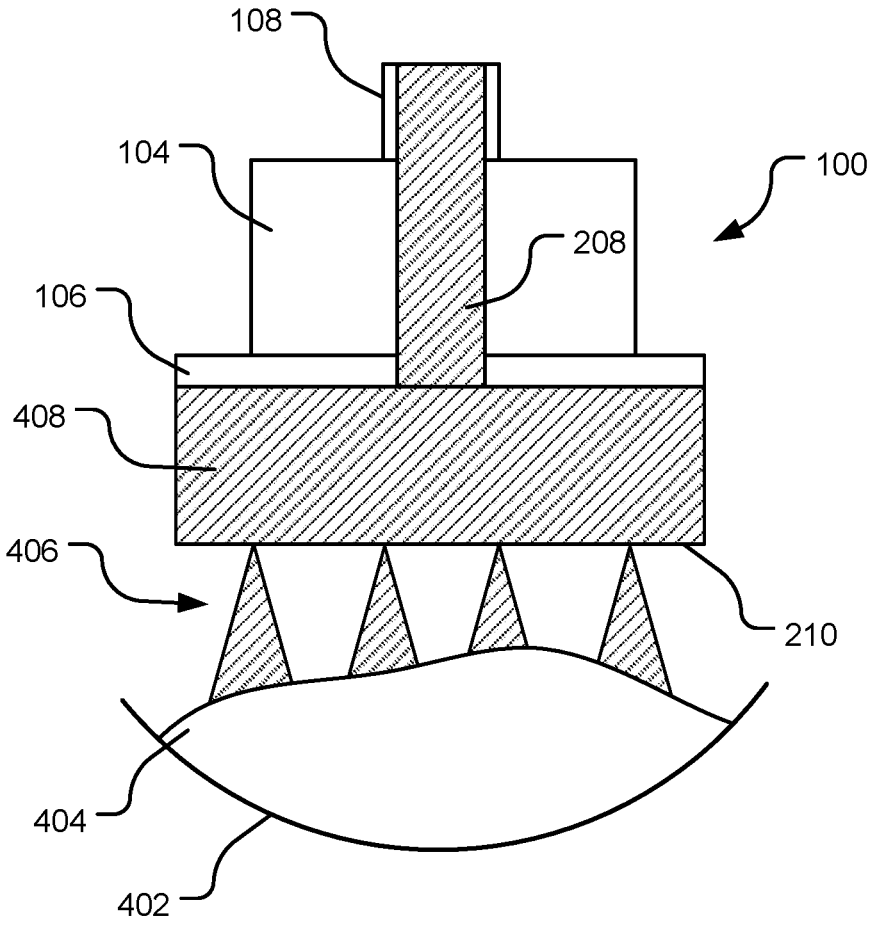
FIG. 4 is a front representative section view of the head assembly shown in FIG. 1 further including a representative view of a conveyor belt conveying aggregate under the head, and the head distributing liquid nitrogen onto the aggregate to pre-cool the aggregate.

FIG. 4 is a front, representative section view of the head assembly 100 further including a representative view of a conveyor belt 402 conveying aggregate 404 under the head, with the head distributing liquid nitrogen 406 onto the aggregate to pre-cool the aggregate for use in concrete batch mixing. As described above, the dispensing head 100 may include an intake port 108, a reservoir portion 104 and one or more distribution chambers 106. The intake port 108 may be connected to a tank 202 of a cooling liquid, such as liquid nitrogen. The liquid nitrogen 208 may enter the dispensing head 100 in reservoir portion 104 and flow into one or more distribution chambers 106. In the example illustrated in FIG. 4, the distribution chamber 106 contains some amount of liquid nitrogen 408 as flowing from the reservoir 104 in a manner described above. The bottom surface 210 of the head 100 may include one or more output ports that allow for a dispersal of liquid nitrogen 406 from the distribution chamber 106 onto the aggregate 404 being conveyed by a conveyor belt 402.

Regardless of the particular arrangement and number of output ports 302 or baffles, the head 100 illustrated in FIGS. 1-4 distributes liquid nitrogen over a length (e.g. 2-5 feet) of aggregate 404 below the head 100. Relative to a design without such a length, the present system increases the exposure of the aggregate 404 to liquid nitrogen 406, depending on the rate at which the conveyer belt 402 is traveling, thereby enhancing the cooling effect. In addition, the dispensing head 100 may include deeper penetration by the liquid nitrogen 406 into the aggregate pile 404 on the conveyor belt 402 and longer exposure to both liquid nitrogen and cold nitrogen gas.

In general, the dispensing head 100 of FIGS. 1-4 creates a tortuous path between the space of entry into the head, e.g., the reservoir area 104, and a distribution chamber 106 in fluid communication with the reservoir area. The use of a reservoir and adjacent distribution chambers may also assist in maintaining pressure and evening the pressure reduction as the liquid nitrogen flows through the system and until the liquid nitrogen exits the ports thereby reducing the gas phase transition inside the head. Nonetheless, in alternative embodiments, a head 100 may have one distribution chamber 106, two chambers as shown, or more than two chambers. In one example, particularly suited for a wider conveyor belt, a parallel set of distribution chambers may be provided, with an additional reservoir and intake port to the same or a different source of liquid nitrogen. Referring to an example with one chamber 106, the tortuous path involves the fluid first entering the reservoir 104 and then having an indirect path with some obstacle in the path, e.g., up and over a baffle 204, 206, to reach the distribution chamber. In the example of two distribution chambers 106, there is a tortuous path over the respective baffles 204, 206 into the respective chambers. The liquid, such as liquid nitrogen 208, may be distributed relatively evenly between the two chambers 106, with the volume relative to the reservoir 104 increasing as the fluid enters each chamber. In some implementations, the liquid may not be distributed evenly between the distribution chambers 106 in heads 100 with multiple chambers. For example, the head 100 may include baffles 204, 206 of varying heights such that liquid may enter one of the distribution chambers 106 over a baffle without entering the second distribution chamber. The liquid may then enter the second distribution chamber after the first distribution chamber is at least partially filled. Such an arrangement may be useful if there is a need to alter the amount of liquid nitrogen distributed onto the aggregate to optimize cooling.

Generally speaking, not considering gas boiling effects, the fluid may slow down as it flows into each respective chamber. Moreover, the pressure in each respective chamber may be less than the reservoir area. Either or both factors may help slow down the liquid from the ports in each chamber, and enhance fluid distribution onto the aggregate below. For example, liquid nitrogen 208 is typically stored under pressure in the liquid nitrogen tank. As such, the liquid nitrogen 208 may enter the intake port 108 of the head 100 at a high flow rate that may not be effectively applied to an aggregate 404. For example, applying a high pressure spray of liquid nitrogen 406 onto an aggregate 404 carried on a conveyor belt 402 may cause the aggregate to be blow off the conveyor belt, resulting in various problems including loss of aggregate being included in the concrete mix. Thus, it may be beneficial to reduce the flow rate at which the liquid nitrogen is applied onto the aggregate 404. Through the tortuous fluid path described above, the flow rate or pressure of the liquid nitrogen may be reduced and equalized. More particularly, the flow rate of the liquid nitrogen over the baffles 204, 206 may be less than that of the flow rate of the liquid nitrogen 208 entering the intake port 108. Similarly, depending on the number and size of output ports of a distribution chamber 106, the flow rate of the liquid nitrogen 406 being dispersed onto the aggregate 404 may be less than the flow rate over the baffles 204, 206. The combination of design factors of the dispensing head 100 may all contribute to a control over the flow rate and the slowing the time to gas transition (maintaining liquid nitrogen application to the aggregate) of the liquid nitrogen onto the aggregate 404.

Relative to a design without baffles, there is less variance in flow rates amongst the ports. In a design without baffles, it has been learned that because of the velocity from the liquid due to the boiling effects, significantly higher flow rates can be expected from the ports that are further away from the reservoir. Namely, liquid nitrogen flows in relatively higher proportion from the rows of ports furthest from the reservoir at the most forward and rearward end of the head, with the least amount flowing from the rows of ports immediately adjacent the reservoir. Moreover, liquid nitrogen tends to flow at angles away from the head. In contrast, with the baffles, liquid nitrogen is relatively evenly distributed amongst the ports provided greater fluid distribution to the aggregate below and thereby better cooling penetration. Moreover, liquid flow tends to be straight downward toward the aggregate below, also improving cooling.

Referring again to FIG. 4, it can be seen that the width of the dispensing head 100 may be less than the width of the conveyor belt 402 and aggregate pile 404 on the belt. While other arrangements are possible, providing the head width, or otherwise limiting the output ports 302, to being only over the aggregate 404 on the conveyor belt 402 may aid in reducing liquid nitrogen contact with the belt and focus contact and the cooling effect to only the aggregate on the belt. Among other advantageous, this may help to reduce damage and wear to the belt as the extreme cold of the liquid nitrogen spray 406 may degrade the structural integrity of the rubber or other types of components of the conveyor belt 402. To further aid in protecting the conveyor belt 402, some implementations of the dispensing head 100 may include sidewalls or wings extending from the bottom surface 210 of the dispensing head 100 that reduce the exposure of the belt to liquid nitrogen and generally the cold environment that may damage the belt.

Figure 5:
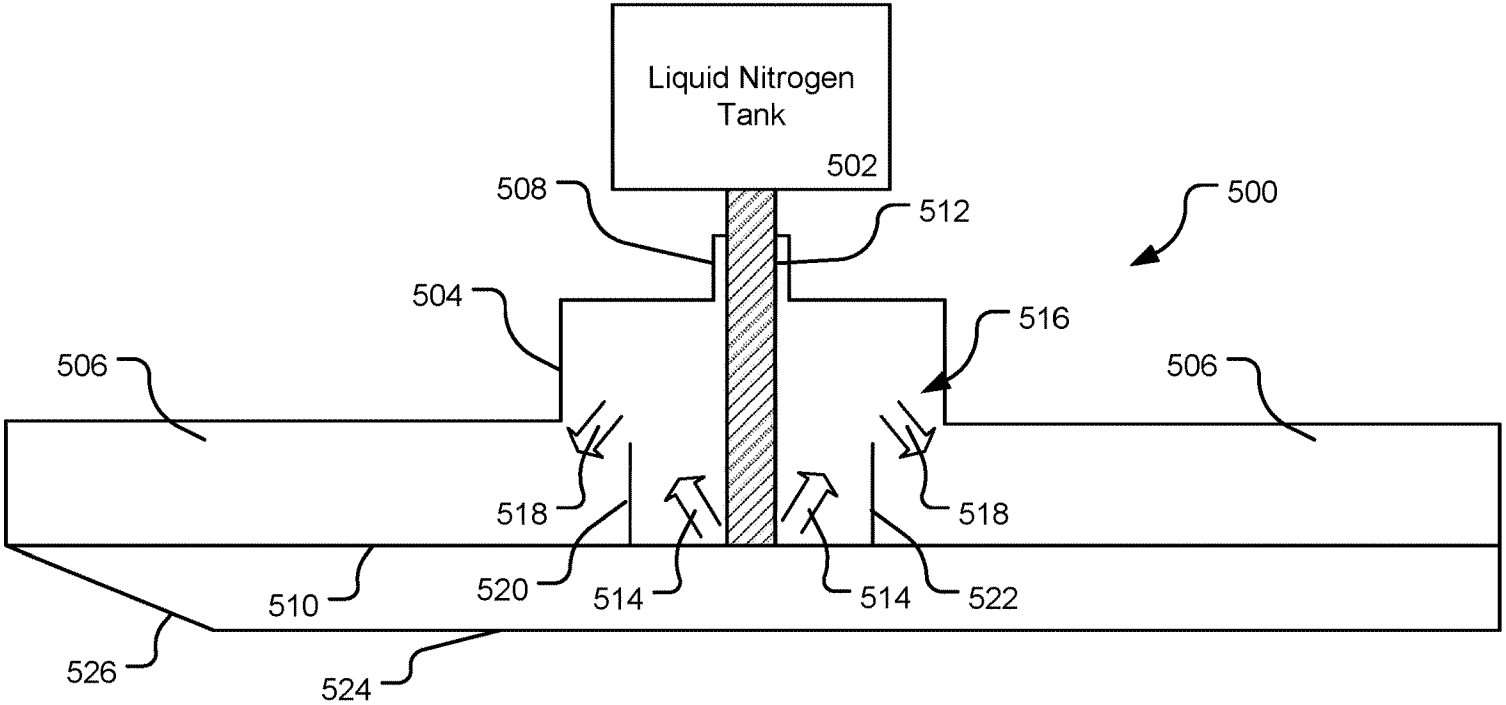
FIG. 5 is a side representative section view of a head assembly according to another embodiment, the head assembly including opposing sidewalls extending downward and outward from respective sides of the head to form an aggregate cooling and deflecting tunnel.
Figure 6:
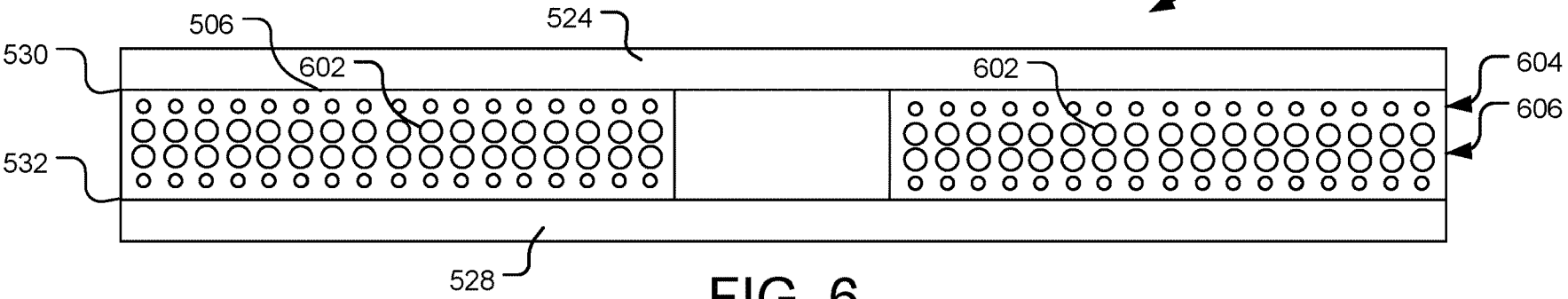
FIG. 6 is a bottom view of the head assembly shown in FIG. 4.
Figure 7:
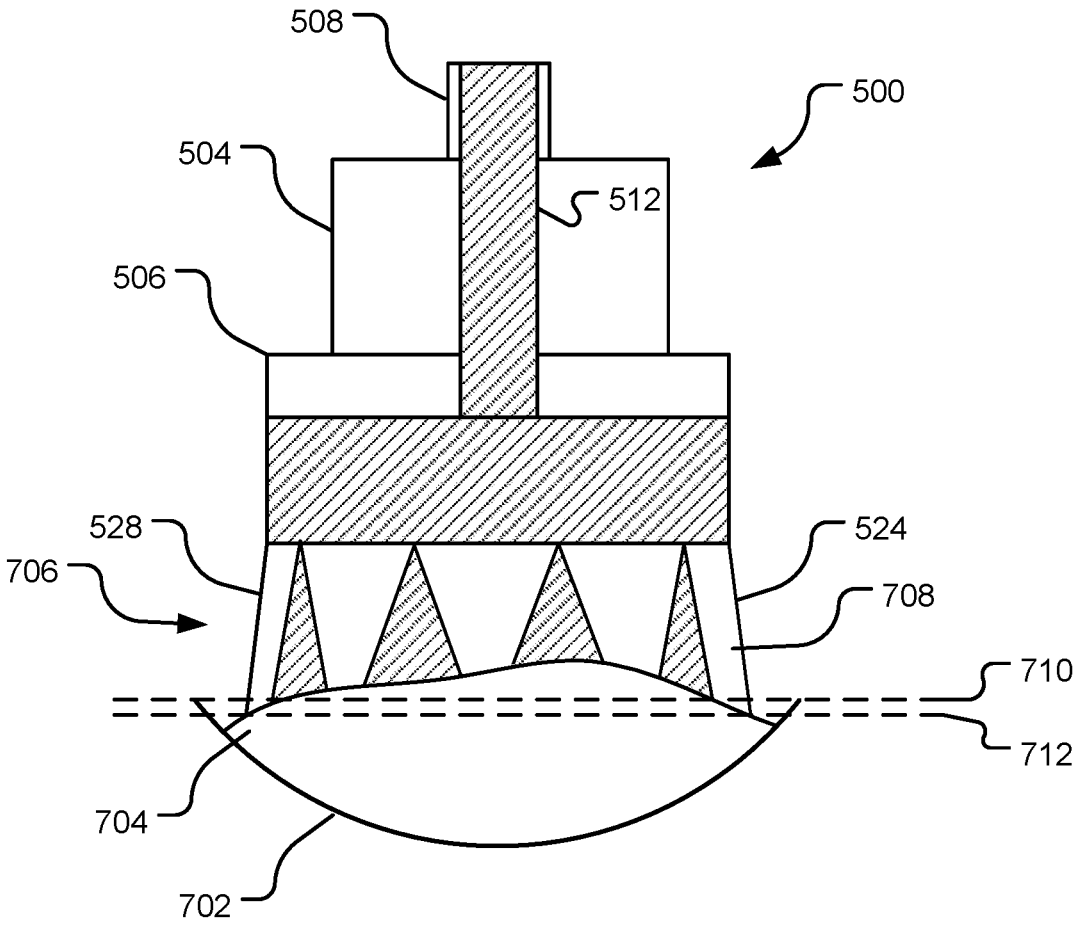
FIG. 7 is a front representative view of the head assembly shown in FIG. 4 further including a representative view of a conveyor belt conveying aggregate under the head and the cooling and deflecting tunnel.

FIGS. 5-7 illustrate an alternative head assembly 500 that further includes sidewalls 524 that extend downward from either side of the dispensing head. Referring to FIG. 5, it can be seen that the head assembly 500 includes many of the same features and structures of the head assembly 100 discussed above with reference to FIGS. 1-4. In particular, the head assembly 500 may include an intake port 508 in fluid communication with a liquid nitrogen or other cooling liquid tank 502. Liquid nitrogen 512 may enter the dispensing head 500 into a reservoir portion 504 of the head and engage a bottom surface 510 of the head. The liquid nitrogen may be dispersed within the reservoir 504 (as shown by flow arrows 514) and contact baffles 520, 522. Space 516 allows the liquid nitrogen to spill (flow arrows 518) over the baffles 520, 522 and into the distribution chambers 506 of the head 500, and through the ports to the aggregate. As such, the features and advantages discussed above with relation to dispensing head 100 may therefore similarly apply to the dispensing head 500 discussed with relation to FIGS. 5-7.

As show in FIG. 6, a bottom surface of the distribution chambers 506 may include one or more output ports 602 through which the liquid nitrogen may flow for dispersion onto an aggregate conveyed on a conveyor belt device. However, as an alternative, the ports may differ in diameter. The implementation of FIGS. 1-4 may similarly include alternative port diameters. In the example illustrated, the outer two rows 604 are of lesser diameter than the inner two rows 606. In this arrangement, more liquid nitrogen flows from the center two rows 606 than the outer two rows 604 thereby distributing relatively more liquid nitrogen along the aggregate near the longitudinal centerline of the belt and relatively less liquid nitrogen to the aggregate along the edges of the belt. Other combinations of port diameters are also possible to alter the liquid nitrogen distribution pattern in any particular implementation.

In addition to the features discussed above, the dispensing head 500 of FIGS. 5-7 may include sidewalls (or "wings") that extends downward from the bottom surface 510 and along the length of the head 500, and which in combination with the lower surface of the head form a cooling tunnel. A first sidewall 524 may extend outwardly from a first edge 530 of the bottom surface 510 along the length of the head 500. A second sidewall 528 may extend outwardly from a first edge 532 of the bottom surface 510 along the length of the head 500. The sidewalls 524, 528 may, in some instances, flare away from the edges 530, 532 of the bottom surface 510 to extend both downwardly and outwardly from the respective edge. It should be recognized that the sidewalls 524, 528 may be longer or shorter than the length of the head 500; moreover, while shown as continuous walls along the respective lengths, the sidewalls may not be continuous or may be fabricated from separate pieces depending on any given implementation.

The sidewalls 524, 528 are generally configured to retain aggregate on the belt and minimize the amount of liquid nitrogen that travels in a transverse direction; thus, minimizing the amount of liquid nitrogen that sprays on the exposed conveyor belt. For example, FIG. 7 illustrates a front, cross-sectional view of the head assembly 500 shown in FIGS. 5-6 that further includes a representative view of a conveyor belt 702 conveying aggregate 704 under the head. Similar to above, the head assembly 500 shown in FIG. 7 includes an intake port 508, a reservoir portion 504, and one or more distribution chambers 506. The intake port 508 may be connected to a tank 502 of a cooling liquid, such as liquid nitrogen. The liquid nitrogen 512 may enter the dispensing head 500 in reservoir portion 504 and flow into one or more distribution chambers 506. The bottom surface of the head 500 may include one or more output ports 602 that allow for a dispersal of liquid nitrogen 706 from the distribution chamber 506 onto the aggregate 704 being conveyed by a conveyor belt 702. The sidewalls 524, 528 extend generally downward from the bottom surface of the dispensing head 500 toward the aggregate 704 and conveyor belt 702. In one implementation, the sidewalls 524, 528 may guide or push the aggregate 704 between the sidewalls as the aggregate is carried below the dispensing head 500 by the conveyor belt 702. In one implementation, the sidewalls 524, 528 may be spaced wider apart at the rear of the dispensing head 500 and taper inward (towards each other) nearer the front of the head. The tapering may further guide the aggregate 704 under the dispensed liquid nitrogen 706 as the aggregate is carried by the conveyor belt 702 such that more of the aggregate may receive the dispensed liquid nitrogen. The sidewalls may also help prevent or reduce liquid nitrogen interaction with the rubber conveyor belt, which helps reduce or prevent damage to the belt.

Further, as noted above, some liquid nitrogen may phase change to gas in the dispensing head 500 or upon exiting the head. This phase change may be accompanied by large volume increases, causing blasts from the output ports 602 directed toward the aggregate 704, which may in turn move the aggregate. In this circumstance, the sidewalls 524, 528 may block aggregate 704 from being blown off the conveyor belt 702 from the blast from the output ports 602. Further, as the aggregate 704 is retained between the sidewalls 524, 528, the dispensing head 500 provides the beneficial effect of mixing the aggregate on the conveyor belt 702 and helping cause deeper penetration of liquid nitrogen 706 into the aggregate. This may expose greater amounts of the aggregate 704 to the cooling effects of the dispersed liquid nitrogen 706. In many instances, the aggregate 704 will be a combination of gravel and sand, which may not be uniformly and homogenously mixed on the conveyor belt 702. Stated differently, depending on the arrangement of providing aggregate 704 to the belt 702, it may be that the aggregate 704 comprises layers of gravel and sand such that the gravel may be layered on the sand or the sand layered on the gravel. The potential mixing effect providing by the liquid and gaseous nitrogen 706 dispersed onto the aggregate 704 may aid in mixing the aggregate while the sidewalls 524, 528 may aid in retaining the aggregate on the conveyor belt 702 and under the nitrogen spray 706. Moreover, should the sand be layered on the gravel, the mixing effect will help cause more liquid nitrogen 706 to penetrate the relatively denser sand matrix and reach the gravel.

The sidewalls 524, 528, as shown, may also define a cooling tunnel 708 in the area between the sidewalls and along the length of the sidewalls. More particularly, a top of the cooling tunnel 708 may be defined by the outer, bottom surface of the dispensing head 500, sides of the cooling tunnel may be defined by the sidewalls 524, 528, and the bottom of the cooling tunnel may be defined by the aggregate/conveyor belt. For example, if the dispensing head 500 and the respective sidewalls 524, 528 are about 5 feet in length, then the tunnel may similarly be 5 feet long and be slightly less than the width of the conveyor belt 702. However, it is possible to extend the sidewalls 524, 528 outside the width of the conveyor belt 702, and similarly make the head 500 larger or smaller relative to the width of the conveyor belt 702. Besides retaining the aggregate 704 within the conveyor belt 702, the cooling tunnel 708 exposes the aggregate to additional cooling through a cooling environment created within the tunnel by the liquid and gaseous nitrogen 706. This cooling effect of the cooling tunnel 708 may enhance cooling relative to a system more exposed to direct atmosphere, which in many cases is likely to be relatively hot in comparison to the cooling environment within the cooling tunnel 708.

Referring to FIG. 7, it can be seen that the sidewalls 524, 528 also may extend both downward and outward from the dispensing head 500 and the leading edge and bottom edge of the respective sidewalls may be positioned to engage the aggregate 704 on the conveyor belt 702. In one particular example, the respective sidewalls 524, 528 are positioned and/or dimensioned such that the bottom edges of the sidewalls (illustrated as sidewall plane edge 712) extend below a plane defined by the outside/upper edges of the belt 702 (illustrated as conveyor plane edge 714). In this way, the sidewalls 524, 528 may engage the aggregate 704 to retain aggregate on the conveyor belt 702.

In addition, referring again to FIG. 5, it can been seen that the leading edge 526 of the respective sidewalls 524, 528 can be beveled. The downward facing edge 526 of the bevel can cut into the aggregate pile 704 gradually deeper as the aggregate moves from the shallower leading edge of the bevel to the deeper trailing edge. Alternatively, the leading edge 526 may be rounded or simply rectangular. In some examples, wear plates may be fixed to the leading edges of the respective sidewalls 524, 528 to prevent wear on the leading edge 526. Similarly, wear plates may be fixed to the beveled edges, should beveling be employed.

Figure 8:
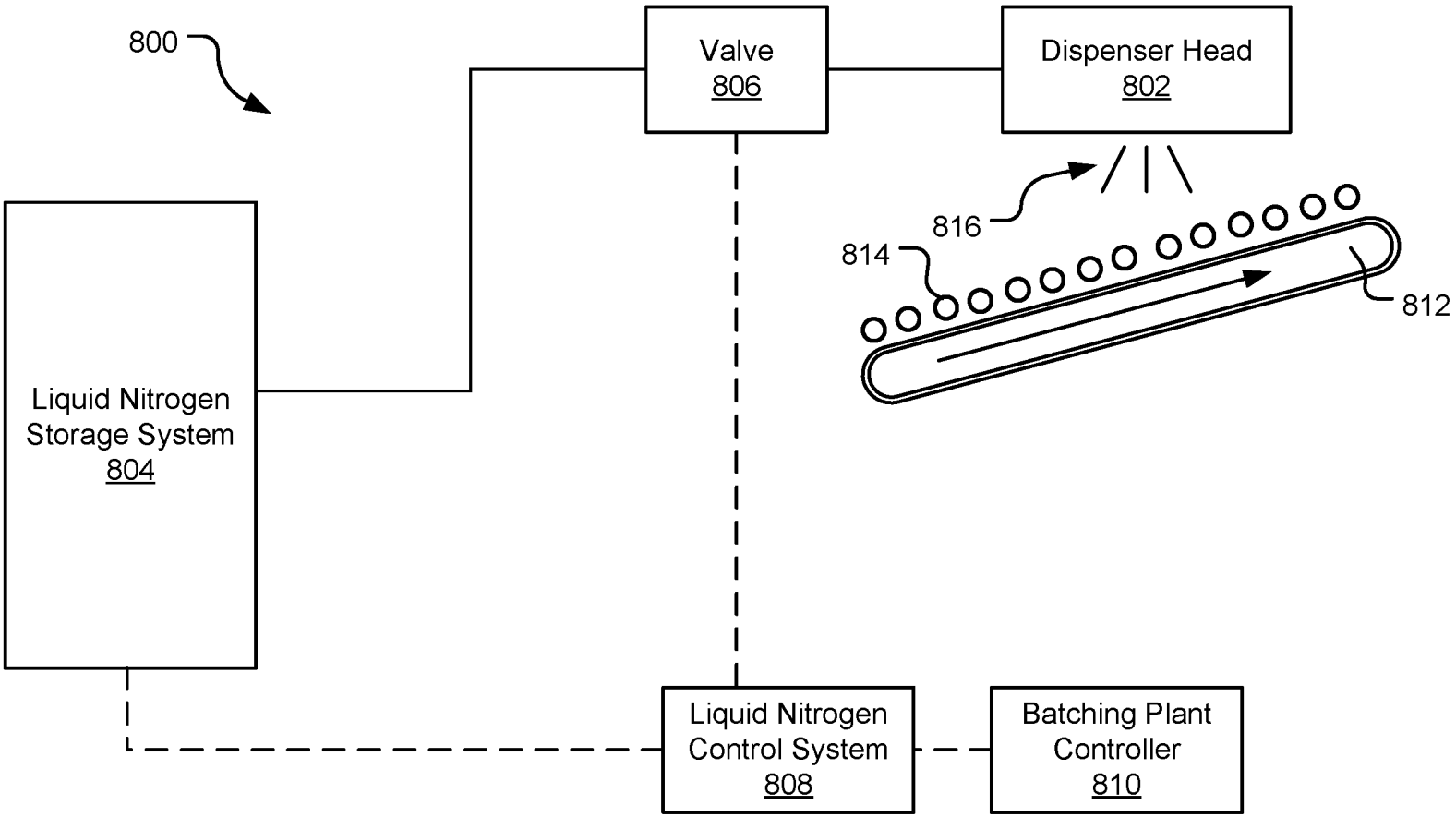
FIG. 8 is a schematic of a system for dispensing liquid nitrogen onto an aggregate of a concrete batching plant.

FIG. 8 is a schematic of a cooling system 800 for dispensing liquid nitrogen 816 onto an aggregate 814 of a concrete batching plant. In one implementation, the system 800 may include a dispensing head 802 as discussed above with relation to FIGS. 1-7. The components of the cooling system 800 may be part of a concrete batching plant at which ingredients for concrete may be mixed or otherwise provided. As discussed above, cooling of an aggregate included in a concrete mix may aid in proper curing of the concrete such that a coolant, such as liquid nitrogen, may be dispensed onto the aggregate at the concrete batching plant. It should be appreciated that additional or fewer components may be included in the system 800 but are not discussed herein for brevity.

As discussed, the cooling system 800 a dispenser head 802 for dispensing a coolant, such as liquid nitrogen 816, onto an aggregate 814 carried beneath the dispensing head by a conveyance system 812. In some implementations, the dispenser head 802 may include the dispenser head 100 discussed above with relation to FIGS. 1-7, with or without the sidewalls extending from the dispenser head into the aggregate 814 conveyed by the conveyance system 812. Liquid nitrogen may be provided to the intake port of the dispenser head 802 from a liquid nitrogen storage system 804. The liquid nitrogen storage system 804 stores a supply of liquid nitrogen, which may be conveyed via a piping system to valve 806 and dispenser head 802. The valve 806 may control the output flow of liquid nitrogen to the dispenser head 802. When the valve 806 is opened, a flow of liquid nitrogen can be output from the valve to the dispenser head 802. As discussed above, the dispensing head 802 may include one or more sidewalls that extend into the aggregate 814 on the conveyor system 812.

In some instances, some components of the system 800 may be controlled automatically. For example, a computerized control system, such as computer implemented liquid nitrogen control system 808, can be communicatively coupled with a liquid nitrogen storage system 804, valve 806, a computer implemented batching plant controller 810, and/or any other component of the system 800. Not all communicative couplings are required, however. By communicatively coupling the liquid nitrogen control system 808 to liquid nitrogen storage system 804 and/or valve 806, the liquid nitrogen control system can control dispensing of liquid nitrogen to the dispenser head 802. This allows the liquid nitrogen control system 808 to control when and for how long a portion of the liquid nitrogen is conveyed to the dispensing head 802 and dispensed onto the aggregate 814, i.e., initiation and cessation. The liquid nitrogen control system 808 can also control the amount of liquid nitrogen dispensed per time (e.g.; the rate of dispensing) and the pressure at which the liquid nitrogen is dispensed by controlling the degree to which the valve 806 is opened.

By coupling the liquid nitrogen control system 808 with the batching plant controller 810, the batching plant controller can send an input signal to the liquid nitrogen control system to indicate when to initiate and cease dispensing liquid nitrogen; how much liquid nitrogen to dispense; and how cold the liquid nitrogen should be, for example. Alternatively, the liquid nitrogen control system 808 could be programmed to control these features independently of a batching plant controller 810.

While not illustrated, it is possible to mount the dispenser head 802 on some form of adjustable structure so that the head may be raised and lowered relative to the conveyor belt 812. In many instances, conditions will be such that liquid nitrogen cooling will be unnecessary, and in those instances, it may be advantageous to move the dispenser head 802 away from the belt 812. There are several structures that may provide relative adjustment between the belt 812 and the head 802. In some instances, the adjustment may be vertical but since the belt 812 may not necessarily be horizontal, relative adjustment is not limited to vertical adjustment. Generally speaking, a translatable structure is coupled with the dispenser head 802. In one example, the dispenser head 802 may be mounted on a frame including one or more adjustable length (translatable) legs. The legs may extend to the ground or be coupled with some structure of the batch plant above the belt 812. In another example, the dispenser head 802 may be coupled to a four bar linkage arrangement with an actuator to articulate the four bar linkage to raise or lower the structure. The actuator may translate vertically, horizontally, or in some other arrangement to pull or push some aspect of the four bar linkage to articulate the structure for raising and lowering the head coupled thereto.

In addition, while the sidewalls 524, 528 are shown being coupled with the dispenser head 500, it is possible to couple the sidewalls to some other component of the dispenser head or the translating structure or to include specific structural support pieces to which the sidewalls 524, 528 are coupled. Also, as the sidewalls 524, 528 may be a wear item of the head 500, they may be removably secured to prevent unnecessary damage to the sidewalls when not in use.

Various modifications and additions can be made to the exemplary embodiments discussed without departing from the scope of the present invention. For example, while the embodiments described above refer to particular features, the scope of this invention also includes embodiments having different combinations of features and embodiments that do not include all of the described features. Accordingly, the scope of the present invention is intended to embrace all such alternatives, modifications, and variations together with all equivalents thereof.

While specific implementations are discussed, it should be understood that this is done for illustration purposes only. A person skilled in the relevant art will recognize that other components and configurations may be used without parting from the spirit and scope of the disclosure. Thus, the following description and drawings are illustrative and are not to be construed as limiting. Numerous specific details are described to provide a thorough understanding of the disclosure. However, in certain instances, well-known or conventional details are not described in order to avoid obscuring the description. References to one or an embodiment in the present disclosure can be references to the same embodiment or any embodiment; and, such references mean at least one of the embodiments.

Reference to "one embodiment" or "an embodiment" means that a particular feature, structure, or characteristic described in connection with the embodiment is included in at least one embodiment of the disclosure. The appearances of the phrase "in one embodiment" in various places in the specification are not necessarily all referring to the same embodiment, nor are separate or alternative embodiments mutually exclusive of other embodiments. Moreover, various features are described which may be exhibited by some embodiments and not by others.

The terms used in this specification generally have their ordinary meanings in the art, within the context of the disclosure, and in the specific context where each term is used. Alternative language and synonyms may be used for any one or more of the terms discussed herein, and no special significance should be placed upon whether or not a term is elaborated or discussed herein. In some cases, synonyms for certain terms are provided. A recital of one or more synonyms does not exclude the use of other synonyms. The use of examples anywhere in this specification including examples of any terms discussed herein is illustrative only, and is not intended to further limit the scope and meaning of the disclosure or of any example term. Likewise, the disclosure is not limited to various embodiments given in this specification.

Without intent to limit the scope of the disclosure, examples of instruments, apparatus, methods and their related results according to the embodiments of the present disclosure are given below. Note that titles or subtitles may be used in the examples for convenience of a reader, which in no way should limit the scope of the disclosure. Unless otherwise defined, technical and scientific terms used herein have the meaning as commonly understood by one of ordinary skill in the art to which this disclosure pertains. In the case of conflict, the present document, including definitions will control.

Additional features and advantages of the disclosure will be set forth in the description which follows, and in part will be obvious from the description, or can be learned by practice of the herein disclosed principles. The features and advantages of the disclosure can be realized and obtained by means of the instruments and combinations particularly pointed out in the appended claims. These and other features of the disclosure will become more fully apparent from the following description and appended claims, or can be learned by the practice of the principles set forth herein.

What is claimed is:

1. An apparatus comprising:

a head coupleable with a source of liquid nitrogen, the head comprising:

a first area that receives liquid nitrogen;

at least one distribution chamber in fluid communication with the first area; and at least one obstruction in a fluid path between the first area and the at least one distribution chamber, the at least one distribution chamber including a plurality of apertures directing liquid nitrogen onto aggregate being carried on a belt beneath the head.

2. The apparatus of claim 1 wherein the plurality of apertures comprises a first plurality of apertures of a first dimension disposed along a bottom surface of the head and a second plurality of apertures of a second dimension less than the first dimension disposed on the bottom surface of the head, the first plurality of apertures directing the liquid nitrogen at a relatively greater volume onto the aggregate as compared to the second plurality of apertures.

3. The apparatus of claim 1 further comprising a wear plate, disposed on a surface of the head, the surface facing and deflecting aggregate being carried on the belt.

4. The apparatus of claim 1 wherein a height of the at least one obstruction is less than an interior height of the at least one distribution chamber to create a flow gap between the at least one obstruction and an upper surface of the head.

5. The apparatus of claim 1 wherein the at least one distribution chamber comprises a first distribution chamber on a first side of the first area and a second distribution chamber on a second side of the first area, the first area defining a first volume less than a volume of the first distribution chamber or a volume of the second distribution chamber.

6. The apparatus of claim 5 wherein the at least one obstruction comprises a first baffle between the first area and the first distribution chamber and a second baffle between the first area and the second distribution chamber, a first gap between the first baffle and the first distribution chamber providing the fluid path between the first area and the first distribution chamber and a second gap between the second baffle and the second distribution chamber providing the fluid path between the first area and the second distribution chamber.

7. The apparatus of claim 1 wherein the at least one obstruction reduces and equalizes a flow rate of the liquid nitrogen received in the first area.

8. The apparatus of claim 7 wherein the source of the liquid nitrogen is a tank storing the liquid nitrogen, the apparatus further comprising:

a controllable valve controlling the flow rate of the liquid nitrogen received in the first area.

9. The apparatus of claim 1 further comprising a liquid nitrogen intake port to the first area.

10. The apparatus of claim 9 wherein the liquid nitrogen intake port is in fluid communication with a flexible hose connecting the intake port to a tank storing the liquid nitrogen, the flexible hose allowing the head to be raised or lowered relative to the belt.

11. The apparatus of claim 1 further comprising:

a first plate extending downward from a first edge of the head toward the belt; and a second plate extending downward from a second edge of the head toward the belt, the first plate and the second plate positioned to at least retain aggregate between the first plate and the second plate as the aggregate passes beneath the head.

12. The apparatus of claim 11 wherein the first plate and the second plate extend down to either side of the plurality of ports to define a cooling tunnel through with the aggregate on the belt passes.

13. The apparatus of claim 11 wherein the first plate comprises a tapered leading edge that may contact aggregate on the belt.

* * * * *